US005540596A

United States Patent [19]

Bothe et al.

[11] Patent Number: 5,540,596

[45] Date of Patent: Jul. 30, 1996

[54] ELECTRIC PLUG FOR SUPPLYING CURRENT TO ELECTRIC APPLIANCES

[75] Inventors: Michael Bothe, Ladbergen; Peter Grad, Münster, both of Germany

[73] Assignee: Friemann & Wolf Geraetebau GmbH, Ostbevern, Germany

[21] Appl. No.: 255,022

[22] Filed: Jun. 7, 1994

[30] Foreign Application Priority Data

Jul. 2, 1993 [DE] Germany ..... 43 22 087.8

[51] Int. Cl.[6] ..... H01R 29/00

[52] U.S. Cl. ..... 439/76.1; 439/172; 439/518

[58] Field of Search ..... 439/76, 166, 170–175, 439/218, 518, 329

[56] References Cited

U.S. PATENT DOCUMENTS

| | | | |
|---|---|---|---|
| 2,866,957 | 12/1958 | Raypholtz | 439/606 |
| 3,182,280 | 5/1965 | Daut et al. | 439/148 |
| 3,996,546 | 12/1976 | Hugly | 336/107 |
| 4,815,983 | 3/1989 | Erickson | 439/173 |
| 4,973,827 | 11/1990 | Nozaki | 439/173 |
| 5,135,406 | 8/1992 | Ishikawa | 439/131 |
| 5,159,545 | 10/1992 | Lee | 439/173 |
| 5,160,879 | 11/1992 | Tortola | 439/131 |
| 5,194,016 | 3/1993 | Hatagishi et al. | 439/354 |
| 5,207,594 | 5/1993 | Olson | 439/490 |

FOREIGN PATENT DOCUMENTS

3300936A1 7/1984 Germany .

1595897 8/1981 United Kingdom .

*Primary Examiner*—Neil Abrams

*Attorney, Agent, or Firm*—Townsend and Townsend and Crew

[57] ABSTRACT

A device is described for supplying electrical current to electric appliances, especially mobile appliances. The device has a plug housing (1) equipped with an electric plug which houses the electrical and electronic components supplying the current. To simplify the use of the device with various electric socket configurations, several interchangeable adapter plugs (17) are provided which can be releasably attached to the plug housing (1). Each adapter plug has contact pins which are shaped and arranged according to electric socket configurations used in various countries. The adapter housing has contact springs (20) which are electrically coupled to the contact pins (19) and which contact corresponding current supply contact surfaces (8) carried by the plug housing (1). The plug housing (1) has a recess (2) into which a tongue (8) of an electronic circuit board (6) protrudes and on which the contact surfaces are formed. The adapter housing fits into the depression (2) so that the contact springs (20) engage the contact surfaces (8) of the circuit board (6) when assembled. A releasable snap-on lock formed by the adapter housing and the plug housing (1) secures the two to each other. When the device is not in use a closure (10) is releasably placed over the recess to protect it against damage and contamination.

7 Claims, 3 Drawing Sheets

ELECTRIC PLUG FOR SUPPLYING CURRENT TO ELECTRIC APPLIANCES

BACKGROUND OF THE INVENTION

The invention concerns an plug-in adapter electric power plug for supplying current to electric appliances. The plug-in adapter has a plug housing, equipped with electric contacts and which contains the electrical and/or electronic components that supply the current.

Electric appliances operating on low voltage current are in increasing use. They receive their power from plug-in adapter which reduce the voltage supplied to the appliance as needed. This is also the case for appliances operating with rechargeable batteries. Conventional plug-in adapters used for this purpose consist of a plug housing, which contains the electric or electronic components which supply the current and contact pins which are firmly integrated in the housing. For the supply of current the adapter is plugged into an electric socket or wall outlet. Since different wall socket outlets are used in different countries, e.g., Germany, Great Britain, the U.S.A., Australia, etc., plug-in adapters are on the market with correspondingly arranged and sized contact pins. A consequence of this is that when transportable electric appliances, e.g., laptop computers, video recorders, mobile telephones, etc., are taken along on trips to such countries, an appropriately constructed power plug is always necessary. Conventional adapters for use with different socket or outlet configurations are as a rule unsuitable for such power plugs because as a consequence of their weight they can easily fall out of the connected position.

SUMMARY OF THE INVENTION

The present invention provides such a plug-in adapter which can readily be adapted to the differing contact pin shapes and configurations used in a number of countries.

This is achieved according to the invention by providing several interchangeable adapter plugs which can be attached to the plug housing, each with one of the electric contact pin configurations common in a country. The adapters have contact springs electrically connected with the contact pins, the contact springs coming in contact with corresponding current supply contact surfaces in the plug housing.

The present invention provides the advantage that adapter plugs become part of the plug-in adapter and are readily attached to it in a simple manner. When assembled, they can be plugged into and become securely seated in an electric socket as a unit.

The plug housing of the invention has a recess at an edge of the housing into which a tongue of an electronic circuit board protrudes. The tongue has contact surfaces and the adapter plug includes an adapter housing which fits into the recess so that, when assembled, the contact springs engage the contact surfaces of the circuit board. This configuration makes it possible to give the plug-in adapter the shape of a flat cassette. The recess has spaced-apart sides with opposing grooves into which guide rails on corresponding sides of the adapter housing can be inserted. This enables a rapid and simple insertion of the adapter plug. It is more securely connected to an electric socket because the contact pins are at a right angle to the guide rails.

The invention also provides a closure which fits into the recess in the plug housing. It too has lateral guide rails which can be slidably inserted into the grooves of the plug housing. The closure assures that the plug-in adapter is closed when not in use and protects the contact surfaces of the circuit board from damage and contamination.

To more securely attach the adapter plug or the closure to the plug housing, the plug housing is preferably equipped with a protrusion which cooperates with a flexible catch to form a releasable snap-on lock.

Plug-in adapters which are too heavy to be hung from a wall outlet, for example, and are separately placed on a support surface are preferably provided with an, electric cord which connects the adapter housing with an electric plug. In this embodiment the adapter housing is secured to the plug housing, and the electric plug at one end of the electric cord is plugged into the electric socket.

BRIEF DESCRIPTION OF THE DRAWINGS

In the drawing the same reference numbers are used for parts which are the same or have the same function.

DESCRIPTION OF THE PREFERRED EMBODIMENTS

Figure 1:
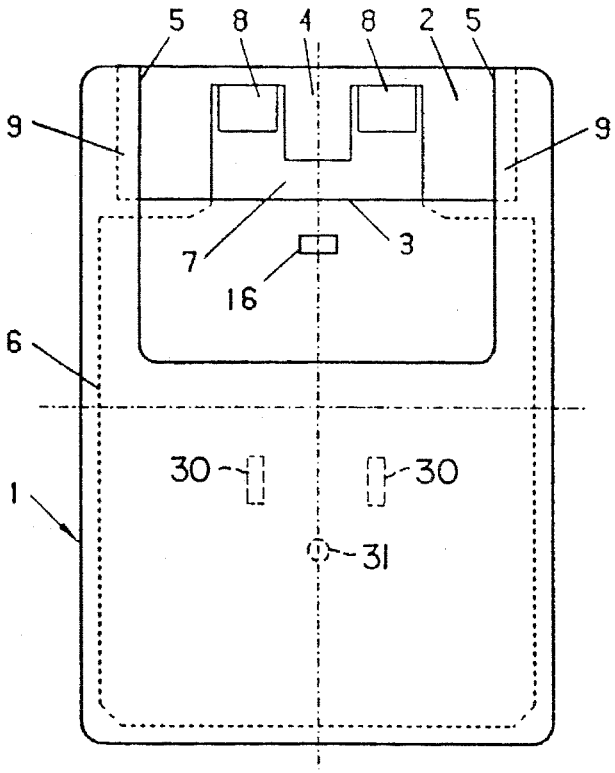
FIG. 1 is a front elevational view of a plug housing constructed in accordance with the invention and illustrates an exterior recess.
Figure 2:
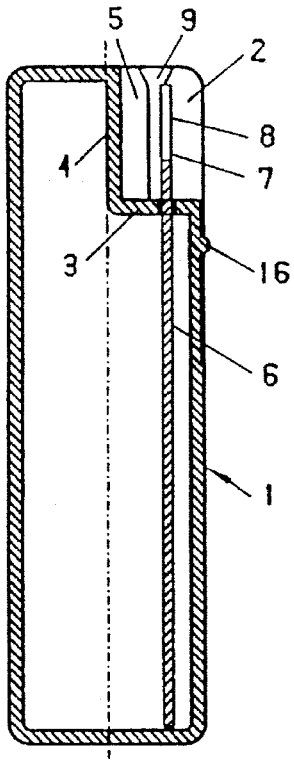
FIG. 2 is a side elevational view, in cross-section, of the plug housing shown in FIG. 1 and is taken along the vertical center line of the housing.
Figure 3:
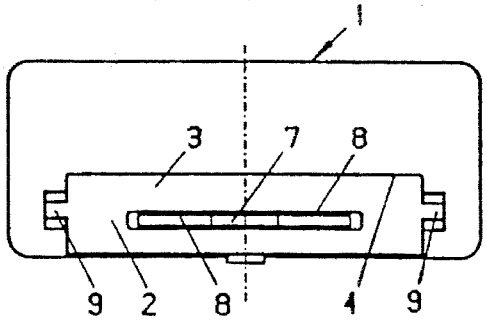
FIG. 3 is a plan view of FIG. 1.

The plug-in adapter of the present invention includes a plug housing, shown in FIGS. 1 through 3, which is shaped like a flat cassette and is preferably made of plastic. At its top edge is a recess or depression 2 defined by a base 3, a back wall 4 and two opposing, spaced-apart side walls 5. Inside the housing is a circuit board 6 which carries the electrical and electronic components needed for supplying the current. The board has a tongue 7, which protrudes into recess 2 through an opening in the base 3. The tongue is fork-shaped and forms two contact surfaces 8 at its ends. The side walls 5 have an opposing groove 9 in them.

As is conventional, appropriately shaped and spaced apertures 30, 31 are provided; for example, on the side of housing 1 opposite the side on which recess 2 is located. The slots are for receiving, for example, the contact pins (not shown) of a conventional electric plug (not shown).

Figure 6:
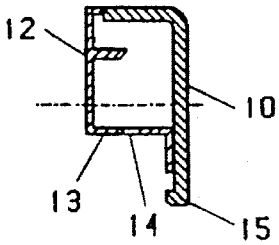
FIGS. 4–6 illustrate a closure for the recess in the plug housing in side view, front view and a center cross-section, respectively.
Figure 4:
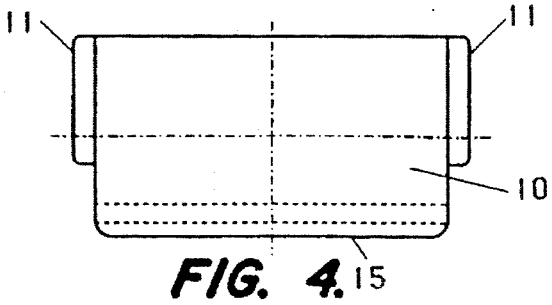
Figure 7:
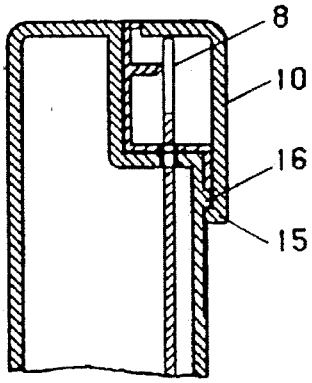
FIG. 7 is a fragmentary view similar to FIG. 2 and illustrates the closure covering the housing recess.
Figure 5:
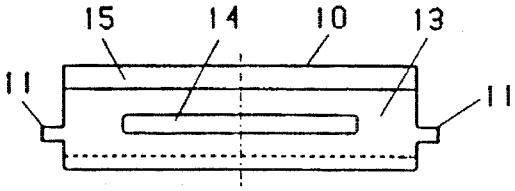

FIGS. 4 through 6 show a closure 10 for placement over recess 2. The closure has lateral guide rails 11 which are sized and positioned so that they can be pushed into grooves 9 of the housing 1. FIG. 6 shows that the back side of closure 10 has an inside wall and a transverse wall 13 with a slit 14 as is clearly shown in FIG. 5. When assembled a flexible catch formed by the lower edge of closure 10 engages a protrusion 16 on housing 1 to securely retain the closure on the housing by requiring the application of a force before the closure can be disengaged.

Figure 8:
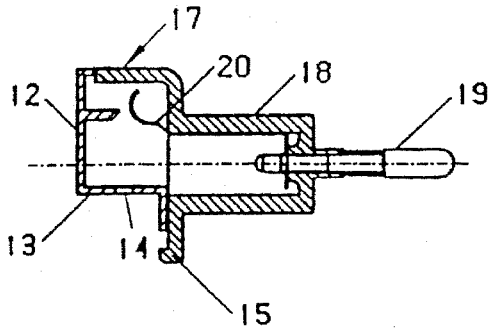
FIGS. 8 and 9 are a center cross-sectional view and plan view, respectively, of an adapter plug constructed in accordance with the invention.
Figure 9:
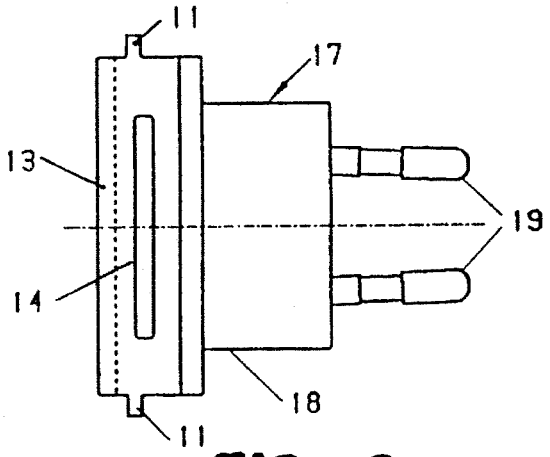
Figure 10:
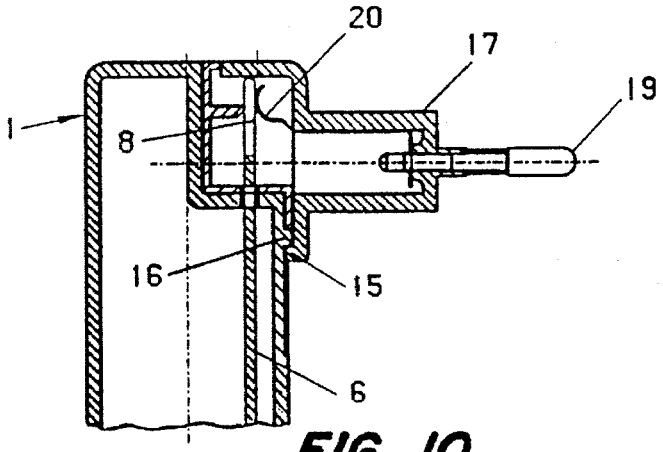
FIG. 10 is a fragmentary view similar to FIG. 2 and illustrates the adapter plug of FIG. 8 in place.

An adapter plug 17 constructed in accordance with the invention is shown in FIGS. 8 and 9. It is shaped so that it fits snugly into depression 2 of housing 1 and includes an adapter housing 18, also made of a suitable plastic, with two contact pins 19 which, in the embodiment shown in FIGS. 8 and 9, are arranged and shaped like so-called Euro-plugs. Each contact pin is connected to a contact spring 20 arranged on the inside of the adapter housing. When the adapter plug is inserted in recess 2, the springs establish contact with the contact surfaces 8 on the circuit board 6. The adapter housing 18 also has an inner wall 12, a transverse wall 13, and a slit 14, in a way similar to cover 10. It also includes a flexible catch 15 which, when assembled, reaches over protrusion 16 of the housing 1 as is shown in FIG. 10.

Figure 11:
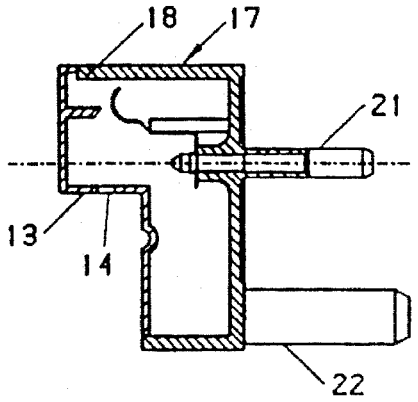
FIGS. 11 and 12 illustrate further embodiments of the adapter plug and are center cross-sectional and plan views, respectively.
Figure 12:
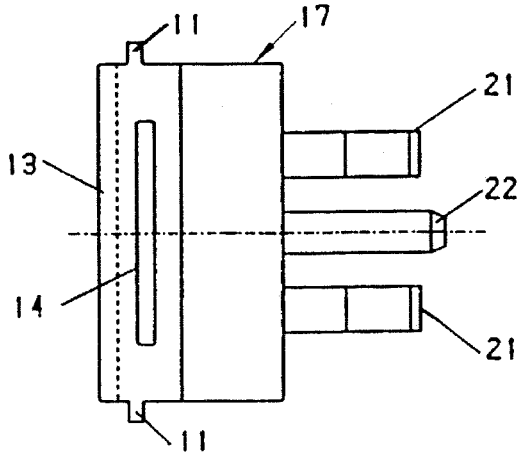

Another adapter plug 17 is shown in FIGS. 11 and 12. It is suitable for electric sockets in use in Great Britain. The contact pins are correspondingly shaped and arranged and the plug includes a support pin 22.

Figure 13:
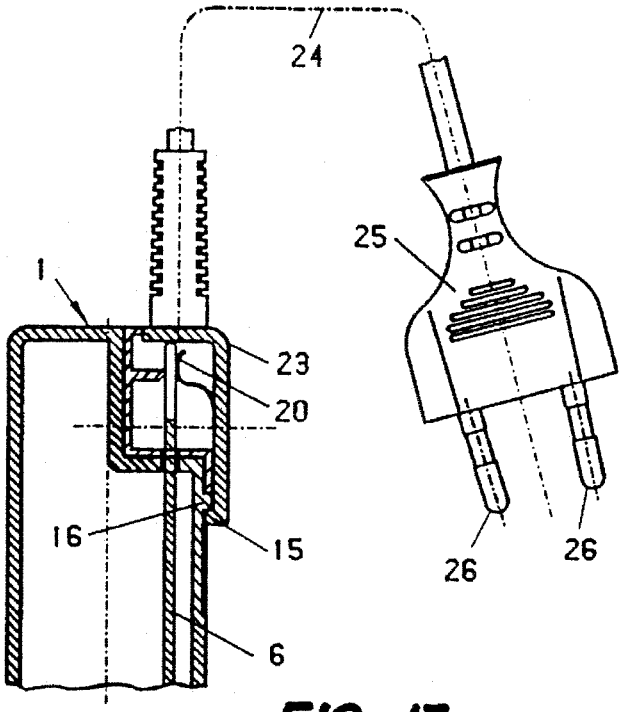
FIG. 13 is a fragmentary side elevational view, in section, of an adapter plug, an adapter housing and an electric cord carrying an electric plug at its free end.
Figure 14:
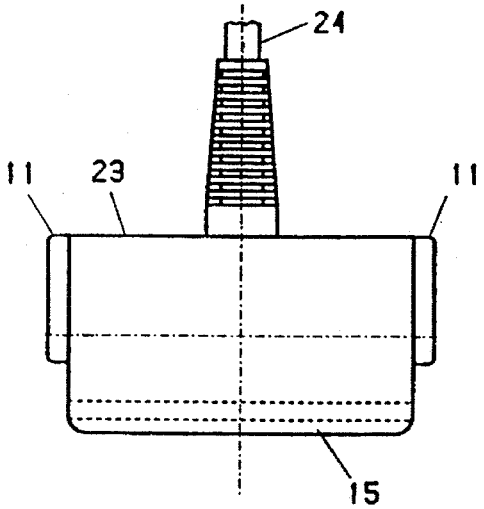
FIG. 14 is a plan view of the adapter housing shown in FIG. 13.

When the plug housing is relatively heavy it is typically not directly plugged into an electric socket, but is supported separately. As shown in FIGS. 13 and 14, in such an event an electric cord 24 connects adapter housing 23 to a suitable electric plug 25 with contact pins 26. Cord 24 is electrically connected with the contact springs 20, which protrude into the inside of housing 23 to establish contact with the contact surfaces on circuit board 6. As in the previously described embodiments, guide rails 11 are provided which can be pushed into grooves 9 of housing 1.

Adapter plugs 17 can also be fitted with contact pins which are sized and arranged for use with other types of electric plugs.

What is claimed is:

1. Apparatus for supplying current to an electric appliance comprising a plug housing including an external recess and electronic components for supplying the current, electrical contact surfaces carried by the housing and electrically coupled to the components, the electronic components including a circuit board having a tongue, and wherein said electrical contact surfaces are on the tongue an adapter plug including an adapter housing configured to be received in the recess, means for removably attaching the adapter plug to the plug housing, electrical contact pins operatively connected with the adapter plug which are shaped and arranged for insertion in pin receiving openings of an electrical socket, and contact springs electrically coupled to the contact pins and arranged to establish electric contact with the contact surfaces when the adapter plug is attached to the plug housing, the contact springs engaging the contact surfaces on the circuit board when the adapter plug is inserted in the recess, whereby the adapter plug can be replaced with another adapter plug having contact pins arranged for insertion in pin receiving openings of a differently configured electrical socket.

2. Apparatus according to claim 1, wherein the recess forms first and second, spaced-apart sides each having a groove, and wherein the adapter housing has guide rails arranged to be slidably placed into the grooves.

3. Apparatus according to claim 2 wherein the contact pins protrude from the adapter housing at a substantially right angle to the guide rails.

4. Apparatus according to claim 1, including a closure for protecting the recess and fitting into the recess, and wherein the closure and the adapter housing define cooperating grooves and guide rails for attaching the closure to and removing it from the plug housing.

5. Apparatus according to claim 1 including an electric cord having one end operatively coupled to the adapter housing and an electric plug carrying the contact pins at another end thereof.

6. Apparatus according to claim 1, wherein the plug housing includes a protrusion and the adapter housing includes a flexible catch engaging the protrusion when the adapter housing is seated in the recess to thereby releasably secure the adapter housing to the plug housing.

7. Apparatus according to claim 4 wherein the plug housing and the closure define a releasable snap-on connector which removably secures the closure to the plug housing by slidably moving the guide rails along the grooves.

* * * * *